United States Patent [19]

Bear

[11] 4,220,443

[45] Sep. 2, 1980

[54] ELECTRO-MECHANICAL CHEMICAL FIREARM DEVICE

[76] Inventor: Russell M. Bear, 707 Stevenson Rd., Severn, Md. 21144

[21] Appl. No.: 904,208

[22] Filed: May 9, 1978

[51] Int. Cl.[2] ..... F41H 9/00; F23Q 7/06

[52] U.S. Cl. ..... 431/91; 431/255; 431/256; 431/258

[58] Field of Search ..... 431/91, 255, 258; 361/253, 256

[56] References Cited

U.S. PATENT DOCUMENTS

| | | | |
|---|---|---|---|
| 1,463,518 | 7/1973 | Thomas | 431/91 |
| 2,482,794 | 9/1949 | Peterson | 431/91 |
| 2,601,893 | 7/1952 | Funke | 431/91 |
| 2,666,480 | 1/1954 | Peterson | 431/255 |
| 2,971,573 | 2/1961 | Griffin et al. | 431/91 |
| 3,016,086 | 1/1962 | Smith | 431/91 |
| 3,106,238 | 10/1963 | Bruce | 431/91 |
| 3,406,001 | 10/1965 | Ishibashi | 431/255 |
| 3,759,244 | 9/1973 | Konet | 431/255 |
| 3,894,273 | 7/1975 | Newport, Jr. et al. | 361/256 |
| 3,918,887 | 11/1975 | Lampbrecht et al. | 431/255 |
| 4,089,636 | 5/1978 | Goto | 431/255 |

FOREIGN PATENT DOCUMENTS

| | | | |
|---|---|---|---|
| 2303168 | 8/1973 | Fed. Rep. of Germany | 431/255 |
| 216441 | 12/1941 | Switzerland | 431/91 |

*Primary Examiner*—Charles J. Myhre
*Assistant Examiner*—P. S. Lall
*Attorney, Agent, or Firm*—Walter G. Finch

[57] ABSTRACT

The invention is an improved chemical firearm device that is operated and fired by an electro-mechanical system. The firearm device is of a pistol configuration, having a tank-like handle or hand-grip for containing the chemical to be discharged. A dual-action mechanical trigger mechanism is provided for first discharging the chemical through a nozzle in the barrel portion of the pistol-like device, which can be aimed like a pistol toward an assailant or target, and second to ignite the chemical during discharge if desired. An optional action is available whereby the ignition of the already discharged chemical on the assailant, or on the target, may be delayed until desired or needed in a point of close combat with the assailant or at the target. Another optional action is the availability of a high-voltage charge to stun and disable an assailant during close combat without the use of the chemical. Other uses include destruction of pest nests, and similar situations.

7 Claims, 2 Drawing Figures

ELECTRO-MECHANICAL CHEMICAL FIREARM DEVICE

BACKGROUND AND SUMMARY OF THE INVENTION

The invention relates to firearms and in particular to chemical firearms. Specifically, it relates to a chemical firearm device that can operate in the usual manner like a chemical firearm and also with a delayed action for igniting the chemical from the firearm device. It has an alternate means of use, in that it can be used as a hand-held high-voltage unit that can be used to stun an assailant or enemy.

The device of this invention is self-contained for operation having a built-in chemical tank, an electro-mechanical firing mechanism, and a mechanism for the build up of a high voltage for the alternate use. The electrical system of the device is rechargeable.

The device is equipped with a dual-action trigger that can be used to discharge chemical only up to 20 feet or more on the assailant or target, to ignite the chemical during discharge from the device, or to delay that ignition of the chemical until later at a desired moment of need during close combat. The same trigger mechanism can be used for applying a high-voltage discharge to an assailant or enemy to stun the subject.

The device is of an automatic pistol-like configuration and can be aimed like a pistol. The device can be made of larger proportions and greater volume, or it may be made in miniature size for emergency use. The chemical firearm device will hold enough fuel for at least a ten second discharge or longer, depending on the size of the tank designed for it. Such variations are to be understood to be within the scope and intent of this invention.

It is, therefore, an object of the invention to provide a chemical firearm device of pistol-like configuration.

It is a further object of the invention to provide a chemical firearm device having an electro-mechanical firing mechanism.

It is another object of the invention to provide an operating mechanism for the chemical firearm device to discharge the chemical only, to ignite the chemical during discharge, or to delay the ignition of the chemical until a later need during close combat or contact with the target.

It is still another object of the invention to incorporate into the operating mechanism of the chemical firearm device a means for providing a high-voltage discharge in order to stun an assailant or enemy during close combat or contact.

It is yet another object of the invention to provide a chemical firearm device that is self contained for operation.

Further objects and advantages of the invention will become more apparent in light of the following description of the preferred embodiments.

DESCRIPTION OF THE PREFERRED EMBODIMENT

Figure 1:
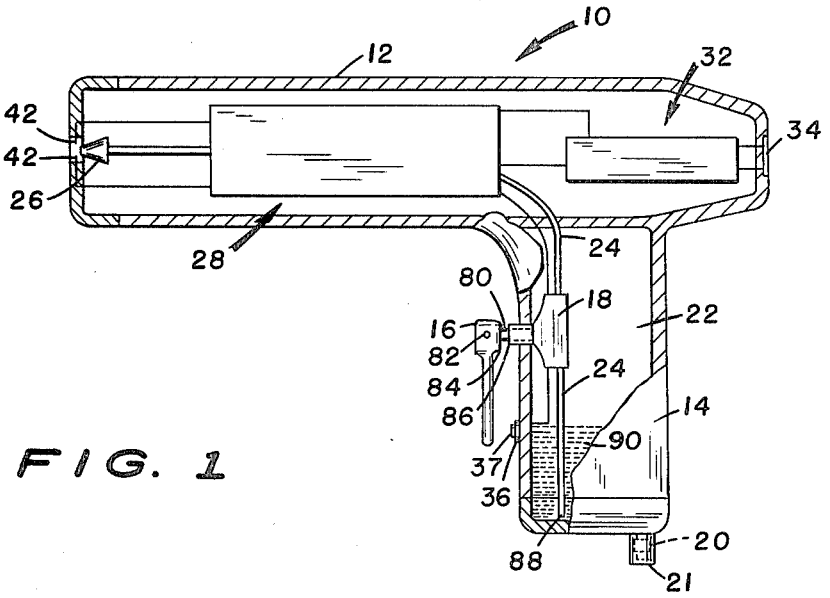
FIG. 1 is a longitudinal section through the electro-mechanical chemical firearm device.

Referring to the drawings, and particularly to FIG. 1, an electro-mechanical chemical firearm device is shown at 10. FIG. 1 is a longitudinal section through the chemical firearm device 10. The configuration of the chemical firearm device 10 is pistol-like, having a handle means 14, surmounted by a barrel means 12. Both the handle means 14 and the barrel means 12 are hollow. The bottom or butt end of the handle means 14 and the muzzle end of the barrel means 12 are detachable (not numbered) for installing mechanisms hereinafter described.

The interior of the handle means 14 is the fuel tank means 22. The structure of the fuel tank means 22 can be seen to be totally enclosed and separated and sealed at the top from the barrel means 12 at the juncture therewith.

The interior of the handle means 14, also contains the inlet end 88 of the fuel line 24, said inlet end 88 being installed a small distance or gap from the bottom or butt end of said handle means 14 and within the fuel tank means 22 to permit the fuel to enter the fuel line 24 as hereinafter described. Said small distance or gap at the inlet end 88 can also be accomplished by small holes in the side of fuel line 24 or by a "V" notch on the bottom edge of the inlet end 88 if said fuel line 24 reaches down the entire distance and rests on the bottom interior surface of the handle means 14.

The fuel release or discharge valve 18 is located on the fuel line 24 inside the handle means 14 within the fuel tank means 22. The fuel release or discharge valve 18 is controlled by a control stem 80 as hereinafter described. Said control stem 80 extends from the trigger 16 to the fuel release valve 18 through a stem housing (not numbered) of the fuel release valve 18, said stem housing passing through the wall of handle means 14 and sealed at the interface of stem housing and said handle means 14. Said seal may be by press fit or screw thread means or other suitable sealing means.

The trigger 16 is pivotally attached to control stem 80 by an axle-like pin 82. When trigger 16 is depressed toward the handle means 14, the back edge 84 of trigger 16 interfaces with the top edge 86 of said stem housing. Further depressing of trigger 16 causes the interface of the back edge 84 of trigger 16 and the top edge 86 of said stem housing to serve as a fulcrum, and as the depressing of trigger 16 continues the control stem 80 is moved outward from fuel release valve 18, thus opening said fuel release valve 18 so that fuel 90 in fuel tank 22 can pass through the fuel release valve 18 as hereinafter described.

As described hereinafter, fuel 90 is under pressure in fuel tank 22. As fuel release valve 18 is opened as hereinbefore described, said pressure in fuel tank 22 pushes fuel 90 up into fuel line 24 by way of inlet end 88 in fuel line 24.

When trigger 16 is released the control stem 80, which is spring loaded internally in fuel release valve 18, returns to its closed position and thus stops the flow of fuel 90 up through fuel line 24.

The fuel line 24 extends upward within fuel tank 22 and passes into the interior of the barrel means 12 through the interface wall of handle means 14 and barrel means 12. Where the fuel line 24 passes through said interface wall the juncture is sealed by soldering brazing, or other suitable means.

Within the barrel means 12 the fuel line 24 extends to end of the barrel means 12 where a nozzle 26 on the end of fuel line 24 directs the fuel 90 out through the opening (not numbered) in the end of the barrel means 12. Said pressure in fuel tank 22 forces fuel 90 out through nozzle 26 when said trigger 16 is depressed, forcing fuel 90 toward an assailant or target as the electro-mechanical chemical firearm device 10 is aimed in pistol-like fashion.

The fuel tank 22 is refilled with fuel 90 through check valve 20 in the bottom of the handle means 14, by means of pumping the fuel 90 into the fuel tank 22 by pressure.

In order to vent the fuel tank 22 during refilling with fuel 90, the chemical firearm device 10 is turned over so that the barrel means 12 is downward and the check valve 20 is upward, thus removing any fuel 90 in fuel tank 22 from the area of the inlet end 88 of fuel line 24 and, at the same time, depressing the trigger 16. Thus, as the pressurized fuel 90 enters the fuel tank 22, the air or any gas in fuel tank 24 is forced out through the open fuel line 22.

Various fuels may be used in the chemical firearm device 10, such as industrial grade ether, hospital grade ether, Diesel starting fluid, or other similar fuels.

When the fuel tank 22 is full, fuel 90 will appear at the nozzle 26 on fuel line 24. Releasing the trigger 16 will stop any flow of fuel 90 out through fuel line 24 and pressure will build up inside fuel tank 22 until the fuel supply line is turned off. A pressure of at least five pounds per square inch is necessary to operate the chemical firearm device 10, however, greater pressures provide a facility for greater distances. A dust cap 21 is provided to cover the check valve 20 after refilling the fuel tank 22.

It is to be understood that a standard pressure gage may be installed in handle means 14 to determine the pressure within the fuel tank 22, such a standard pressure gage is desirable for safety reasons, though not shown on the drawings.

During the operation of the chemical firearm device 10 as aforementioned for discharging fuel 90 on or toward an assailant or target, provisions are made for igniting the fuel 90 as it is discharged as hereinafter described.

A micro-type electrical switch 36 is mounted on the exterior of the handle means 14 under the end of trigger 16. As the trigger 16 is depressed beyond the point where fuel is spewed from the nozzle 26, the end of the trigger 16 will come in contact with the activator button 37 of micro-type electrical switch 36. Further depression of trigger 16 will press the activator button 37 inward to activate the electrical circuit as hereinafter described. The activated electrical circuit will cause a spark to leap across the gap between two electrodes 42 that straddle the nozzle 26 and ignite the fuel 90 being spewed out of said nozzle 26. The spark will cease upon release of the trigger 16 which breaks the circuit.

The wire connections from the micro-like electronic switch 36 are connected to the electronic system inside the barrel means. The wiring may be on the outside of the handle means 14 and fastened thereto and passing into the barrel means in a suitable location to connect to electronic circuit as shown in the wiring diagram. As an alternative, the wiring may be passed through the fuel tank 22 as shown on the drawing, being sealed by suitable means where the wiring passed from the micro-like electronic switch through the wall of the handle means 14, and then through the wall of the barrel means 12 at the top of fuel tank 22, being sealed by suitable means where the wiring passes through said wall of the barrel means 12, for connection to the electronic circuit as shown in the wire drawing.

As an alternative to igniting the fuel 90 as it spews out through the nozzle, the trigger 16 need not be depressed to the point of engaging the activator button 37. Once the assailant or target is doused with the fuel, a surrender can be called for, a first attempt to simply disable an assailant. If there is not a surrender and close combat is encountered, the muzzle end of the chemical firearm device 10 can be pressed against the fuel-wet clothing of the assailant or the fuel-wet target and the activator button 37 operated with a finger or by depressing trigger 16 to ignite the fuel 90 on the assailant or target.

It is to be noted that the trigger 16 may be moved or rotated to one side or the other, pivoting as the control stem 80 turns, thus allowing the activator button 37 to be operated by a finger instead of trigger 16.

An alternative to using fuel 90, either simply to douse an assailant or a target, or to ignite the fuel 90, is to use the high-voltage characteristics of the electronic system as hereinafter described to press the chemical firearm device against an assailant or enemy to stun the assailant or enemy by a high-voltage electrical shock. Another method of simply disabling the assailant or enemy.

As seen in FIG. 1, an electronic circuit 28 for operating the electronic part of the chemical firearm device is shown in the barrel means 12. The wiring diagram for the electronic circuit is shown in FIG. 2.

Figure 2:
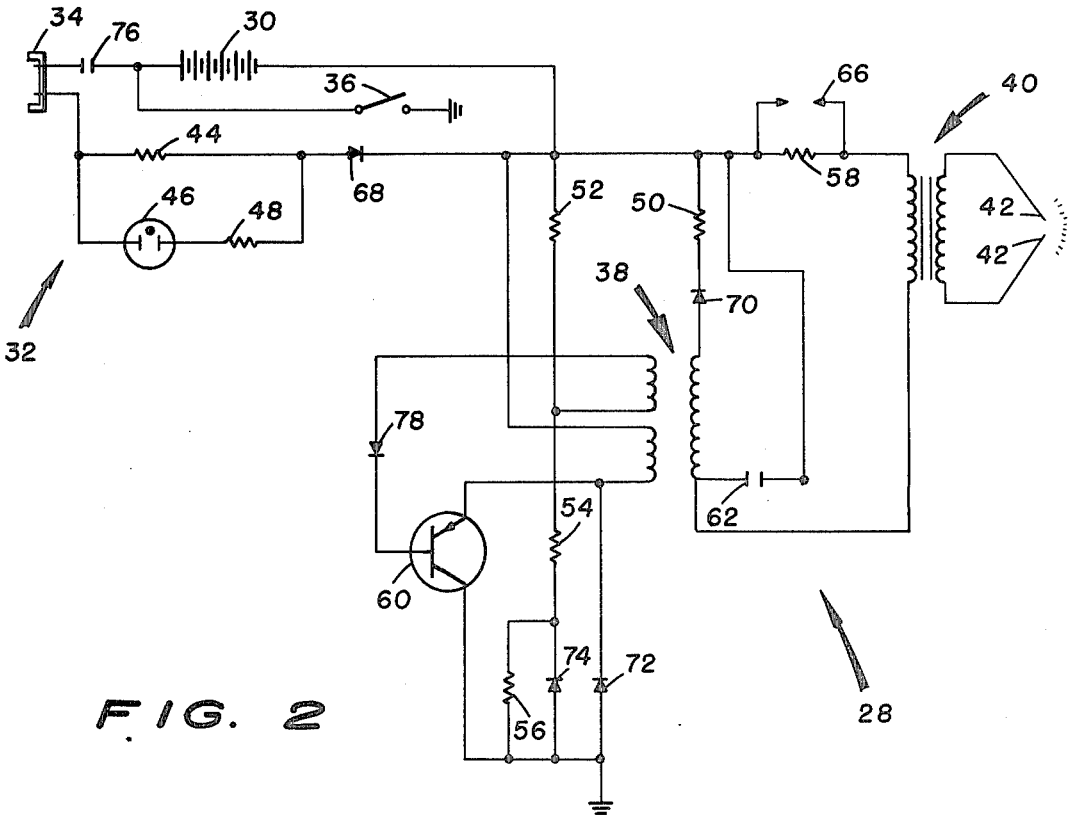
FIG. 2 is a schematic wiring diagram of the electronic system of the electro-mechanical chemical firearm device.

A battery recharging circuit 32 is also shown in FIG. 1, the wiring diagram for which is shown in FIG. 2. Recharging is done from an ordinary house receptacle.

FIG. 1 also shows conductors from the electronic circuit 28 to the electrodes 42 for the igniting spark, and from the battery recharging circuit 32 to the electronic circuit and from the battery recharging circuit 32 to recharge receptacle 34. The electrical wiring is also shown from the micro-like switch 36 to the electronic circuit 28.

It should be noted that recharge receptacle 34 may be female receptacle for a double ended male plug connector, or a recessed male plug for a female receptacle on a female/male connector and that either method is within the scope and intent of this invention. In the case of a recessed male plug, a blank protective female receptacle should be inserted to protect the prongs from accidental contact.

Turning now to FIG. 2 for the wiring diagram. The battery recharging circuit is shown at 32, consisting of the recharging receptacle 34, diode 68, capacitor 76, resistors 44 and 48, and tube 56, to recharge the Ni-Cad battery 30.

The electronic circuit 28 for operation of the chemical firearm device 10 is shown in the other portion of the wiring diagram 28.

Power from battery 30 flows when the micro-like switch 36 is closed. The circuit has a step-up transformer 38 that transforms the battery voltage to 2000 volts or higher. The diagram has an oscillating circuit to provide a high voltage pulsating spark at electrodes 42.

A transister 60, diodes 72, 74, and 78, and resistors 52, 54, and 56 make up the oscillating portion of the circuit. The balance of the circuit for the high voltage system consists of capacitor 62, resisters 50 and 58, diode 70, and spark gap 66 in the circuit with the coil 40 at the electrodes 42.

Uses other than control of assailants, enemies, and similar targets, include the destruction of pest nests (on the ground or in trees), starting charcoal fires, and similar situations. The use of the chemical on pests without the use of igniting the chemical is also possible, whereby the chemical fumes put the pests into a coma for collection.

As can be readily understood from the foregoing description of the invention, the present structure can be configured in different modes to provide the ability to serve as a chemical firearm device that is electro-mechanically operated.

Accordingly, modifications and variations which the invention is susceptible may be practiced without departing from the scope and intent of the appended claims.

What is claimed is:

1. An electro-mechanical chemical firearm device, comprising:

a hollow handle means, said hollow handle means being fully enclosed and capable of containing a fuel under pressure, and a fuel in said hollow handle means under pressure;

a hollow barrel means, said hollow barrel means being surmounted on and attached to one end of said hollow handle means, said hollow barrel means having an open muzzle end;

a fuel piping system, said fuel piping system being within said hollow handle means and said hollow barrel means, said fuel piping system connecting the interior of said hollow handle means to said open muzzle end of said hollow barrel means and communicating therewith, said fuel piping system transporting said fuel from said hollow handle means to said open muzzle end of said hollow barrel means;

an electrical power system within said hollow handle means and said hollow barrel means, said electrical power system being capable of producing a high-voltage spark at said open muzzle end of said hollow barrel means, said high-voltage spark being capable of igniting fuel from said fuel piping system;

a dual trigger mechanism consisting of a first trigger member to release said fuel under pressure in said hollow handle, and a second trigger member to activate said electrical power system to produce said high-voltage spark, said first and second trigger members being capable of concurrent operation and of independent operation, said first trigger member being capable of lateral movement to clear said second trigger member.

2. The electroc-mechanical chemical firearm device as recited in claim 1, wherein said hollow handle means has a check-valve inlet therein for injecting fuel into the interior of said hollow handle means, said hollow handle means serving as a fuel tank.

3. The electro-mechanical chemical firearm device as recited in claim 2, wherein said fuel piping system consists of:

a fuel line, said fuel line having an inlet means at the lower most point of said fuel line in said fuel tank, said fuel line then extending into said hollow barrel means and thence to said open muzzle end thereof, a nozzle at said open muzzle end, said fuel line terminating in said nozzle at said open muzzle end;

a valve in said fuel line, said valve being within said fuel tank, said valve extending through a face of said hollow handle means to connect to said first trigger member for operating said valve, said valve being spring loaded to return to closed position when said trigger is released.

4. The electro-mechanical chemical firearm device as recited in claim 3, wherein said electrical power system is battery powered, said electrical power system having a receptacle for recharging said battery, said electrical power system having two electrodes at said nozzle, said two electrodes having a gap therebetween, said gap being directly across the open end of said nozzle, said high voltage spark occurring across said gap, said high-voltage being established by the operation of second trigger member, said second trigger member being directly under distal end of said first trigger member.

5. The electro-mechanical chemical firearm device as recited in claim 3, wherein said fuel is an ether compound.

6. The electro-mechanical chemical firearm device as recited in claim 1, and additionally, one end of said hollow handle means being removably attached for installation of other mechnaisms therein, and one end of said hollow barrel means being removably attached for installation of other mechanisms therein.

7. The electro-mechanical chemical firearm device as recited in claim 1, and additionally, said hollow handle means surmounted on said hollow barrel means has an approximate automatic pistal configuration.

* * * * *